US006716026B1

(12) United States Patent
Beougher

(10) Patent No.: US 6,716,026 B1
(45) Date of Patent: Apr. 6, 2004

(54) DECORATIVE CANDLEHOLDER AND DISPLAY APPARATUS

(76) Inventor: Mary Kay Beougher, 3466 Wenwood Dr., Hilliard, OH (US) 43026

( * ) Notice: Subject to any disclaimer, the term of this patent is extended or adjusted under 35 U.S.C. 154(b) by 0 days.

(21) Appl. No.: 10/282,761

(22) Filed: Oct. 29, 2002

(51) Int. Cl.[7] ..... F23D 3/16
(52) U.S. Cl. ..... 431/290; 431/291
(58) Field of Search ..... 431/290, 291, 431/293, 126

(56) References Cited

U.S. PATENT DOCUMENTS

| | | | | | |
|---|---|---|---|---|---|
| 1,660,760 | A | | 2/1928 | Murphy | |
| 2,050,151 | A | * | 8/1936 | Baumer | 362/161 |
| 3,077,981 | A | * | 2/1963 | Gaspard | 206/223 |
| 3,604,825 | A | * | 9/1971 | Leshko | 431/290 |
| 4,017,729 | A | | 4/1977 | Frazier, Jr. | |
| 4,035,937 | A | | 7/1977 | Rosenfeld | |
| 4,163,333 | A | | 8/1979 | Kwiatkowski | |
| 4,240,783 | A | | 12/1980 | Nevin et al. | |
| 4,681,534 | A | * | 7/1987 | Schenke et al. | 431/290 |
| 4,755,135 | A | * | 7/1988 | Kwok | 431/290 |
| 5,419,527 | A | | 5/1995 | Adams et al. | |
| 5,613,760 | A | * | 3/1997 | Dunn | 362/161 |
| 5,951,278 | A | | 9/1999 | Young et al. | |
| 6,238,756 | B1 | | 5/2001 | Yee | |
| 6,241,512 | B1 | | 6/2001 | Freeman et al. | |
| 6,253,918 | B1 | | 7/2001 | Greiner | |
| 6,267,584 | B1 | * | 7/2001 | Zou | 431/290 |
| 6,273,710 | B1 | * | 8/2001 | Zou | 431/290 |
| 6,435,694 | B1 | * | 8/2002 | Bell et al. | 362/161 |
| 6,468,071 | B2 | * | 10/2002 | Zou | 431/290 |
| 6,474,980 | B2 | * | 11/2002 | LaVanier | 431/126 |
| 6,520,770 | B2 | * | 2/2003 | Zou | 431/290 |

FOREIGN PATENT DOCUMENTS

GB 2 175 994 * 12/1986

* cited by examiner

*Primary Examiner*—Alfred Basichas
(74) *Attorney, Agent, or Firm*—David J. Dawsey; Michael J. Gallagher; Gallagher and Dawsey Co. LP

(57) ABSTRACT

A decorative candleholder and display apparatus for displaying a plurality of display articles in a display region. The apparatus incorporates, among other elements, a display, a display article, a cap, and a base. The display includes an inner wall and an outer wall. Each wall includes a bottom edge and a top edge. The inner wall is located within the outer wall thereby defining a display region therebetween. Various sizes of display regions accommodate a wide range of display articles including relatively thin articles such as photos, drawings, or needlework, or relatively thick articles such as dried flowers, seashells, quilting, and other three-dimensional articles. Variations on the apparatus include an integral cap and candleholder, a height adjustment system to raise and lower a candle support, and a flame elevation maintenance device including a candle sleeve, a candle compression device, and a plurality of sleeve retainers.

20 Claims, 6 Drawing Sheets

DECORATIVE CANDLEHOLDER AND DISPLAY APPARATUS

TECHNICAL FIELD

The present invention relates to the field of decorative candleholders and display devices; particularly, to a device for conveniently and interchangeably displaying articles within a decorative candleholder.

BACKGROUND OF THE INVENTION

Over the years, various attempts have been made to combine the warmth and atmosphere of candle lighting with artwork displays. Candlelight is richer in red, yellow, and orange colors than most incandescent light, and imparts a warm and flickering illumination that enhances various forms of art.

In some embodiments, candles have been used to back-light translucent art images. Examples include U.S. Pat. No. 1,660,760 to Murphy, wherein a thin layer of religious imagery or inscriptions is made on the wall of a candle containing holder. As the candle tends to burn downward, increasing amounts of devotional imagery or inscription are revealed through a translucent or semi-transparent outer layer.

In a later version of a similar concept, a translucent layer overlaid upon an inner layer adjacent to a flame gives an image the appearance of movement as the candle layer burns downward, as seen in U.S. Pat. No. 4,017,729 to Frazier, Jr. Further refinements include a reflective layer behind the source of illumination so as to project an image, as seen in U.S. Pat. No. 4,163,333 to Kwiatkowski. This concept, that of the candle light passing through a display material from behind, was adapted to shine light through a plurality of gelatinous structures in the wall of the candle holding device by Freeman, et al., in U.S. Pat. No. 6,241,512. Attempts have been made to combine other three-dimensional art displays with integral candles. An example is U.S. Pat. No. 5,951,278 to Young, et al., in which a sealed translucent shell contains glass beads and surround an inner candle. The light of the candle is transmitted through the sealed translucent layer and provides pleasing reflections when refracted through the beads within the enclosure. The disadvantage of this system, as with many of the others noted above, is that the display is limited to those pre-elected in the manufacture of the device, which cannot be altered by the end user.

A different type of embodiment acts to place a flat, two-dimensional image on the outside of a candle holding device, as seen in U.S. Pat. No. 4,240,783 to Nevin, et al., where unlike the above mentioned embodiments, the artistic effect comes from the light shining on the outside of a display, rather than through a display. In the '783 patent, a thin, two-dimensional card is placed in an outside layer surrounding a candleholder. Such a display suffers from the disadvantages of firstly being limited to two-dimensional displays, and secondarily, to being limited as to the types of artwork that might be displayed, being apparently limited to those cards prepared and marketed by the inventors, or at least those which precisely fit the space intended in both height and thickness. A variation on this theme is that of providing cloisonné art displays on the outside candleholder, as seen in U.S. Pat. No. 6,238,756, in which a fixed outer display may be applied to various containers, including a candleholder.

Other attempts to combine art display with candles include those in which a candle illuminates an external art object in proximity to a candle, as seen in U.S. Pat. No. 5,419,527 to Adams, et al. In the '527 patent, a candleholder illuminates an adjacent angelic device. This invention is limited in that the only art which may be combined with the candle is that provided by the inventors as part of the device.

Many persons are actively pursuing artistic creation in such textured, or three-dimensional art as needlework, dried flowers, seashells, or similar three-dimensional objects. They seek to combine their own artistic creations in displays along with the traditional lighting afforded by candles, but present candle-lit display devices have not allowed for this. An optimal solution is a candleholder that is adaptable to a plurality of candle shapes and sizes, allows for display of three-dimensional objects of varying shapes and thickness, allows for the artist or person arranging the display to easily interchange the artwork, without removing the candle and while keeping the artwork protected from dust and other elements while it is on display. The candleholder needs to be rugged, yet inexpensive and easy to manufacture. The instant invention addresses many of the shortcomings of the prior art and allows for all the heretofore unavailable benefits.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations.

In one of the many preferable configurations, the decorative candleholder and display incorporates, among other elements, a display, a display article, a cap, and a base. The decorative candleholder and display apparatus is adapted to secure a candle, having a flame, and display a plurality of items in an internal cavity.

The display has an inner wall and an outer wall. The inner wall has an inner wall bottom edge, an inner wall top edge, and an inner wall periphery. Similarly, the outer wall has an outer wall bottom edge and an outer wall top edge. The inner wall is located within the outer wall thereby defining a display region therebetween. A three-dimensional display article may be inserted into the display region. Display regions of varying sizes may be formed by varying the dimensions of the inner wall and the outer wall. Various sizes of display regions accommodate a wide range of display articles including relatively thin articles such as photos, drawings, or needlework, or relatively thick articles such as dried flowers, seashells, quilting, and other three-dimensional articles.

The configuration of the inner wall and the outer wall may vary. For example, the walls may be circular, triangular, square, rectangular, or any polygon. Additionally, the inner wall and outer wall do not need to be the same shape.

A cap releasably engages the outer wall top edge and the inner wall top edge thereby enclosing the display region at the top edge of the walls, and a base that engages the outer wall bottom edge and the inner wall bottom edge thereby enclosing the display region at the bottom of the walls. The base may include a rotational mount allowing the decorative candleholder and display to rotate 360 degrees facilitating viewing of the entire display. Similarly, the interface between the outer and inner wall bottom edges and the base may incorporate rotational interface allowing the display to rotate 360 degrees while the base, and therefore the candle, remains stationary.

In one of many variations of the present invention, the cap further extends across the periphery of the inner wall thereby forming an integral cap and candleholder. The integral cap and candleholder may extend across the periphery of the inner wall at any point between the inner wall top edge and the inner wall bottom edge accommodating candles of varying heights.

Alternatively, the decorative candleholder and display may include a height adjustment system to raise and lower a candle support. Raising and lowering the candle support allows the elevation of the candle and the flame to be adjusted. The candle support has a support periphery that lies within the inner wall periphery.

In one variation, the height adjustment system may include a telescoping post attached to the candle support at a distal end and attached to the base at a proximal end. The telescoping post may include any number of variations. In one such variation the telescoping post includes two threadedly engagable sections wherein the height of the candle support is adjusted by threading a male threaded section into a female threaded section. In this case, either section may be secured to the candle support so that support elevation may be adjusted simply by rotating the candle support. Alternative variations of the telescoping post include mechanical, electrical, pneumatic, and hydraulic variations including those whereby the height of the candle support may be adjusted via an activation source in the base.

In a further variation of the height adjustment system, the inner wall is formed with a plurality of inner wall engagement shelves. Further, a plurality of adjustable engagement devices are attached to the support periphery and are received by the inner wall engagement shelves. Each of the adjustable engagement devices may include a bendable thumb-grip member which, when bent from an engagement position to a movement position, allows height adjustment of the candle support.

In yet another variation, the base may be formed to extend upward, toward the inner wall top edge, to a predetermined elevation within the inner wall periphery to form an elevated base candle support. The predetermined elevation may be designed to complement standard candle sizes such that a preferred flame elevation is maintained when the candle is at a predetermined state of consumption.

Alternatively, a preferred flame elevation may be maintained using a flame elevation maintenance device. In one such variation, the flame elevation maintenance device may include a candle sleeve releasably mounted to the base and formed to define a hollow region for housing the candle and a candle compression device. The candle compression device acts to force the candle against the candle sleeve such that as the candle melts, the compression device expands thereby forcing the candle against the sleeve and maintaining the flame at a preferred flame elevation. The candle compression device may be as simple as a spring, or may include various mechanical, electrical, pneumatic, and hydraulic variations.

The size of candle sleeve and compression device may vary to accommodate the dimensions of any number of candles. An additional benefit of this variation of the flame elevation maintenance device is that the candle is confined within the candle sleeve and is less likely to tip over and ignite the display than a freestanding candle. The candle sleeve may be secured to the base in any number of ways. One example includes a plurality of sleeve retainers releasably mounted to the base that releasably secure the candle sleeve. As such, the sleeve retainers may secure the candle sleeve in a quick-connect quarter turn type fashion. Additionally, the sleeve retainers may secure to the base in a plurality of locations. For example, the base may include a number of engagement positions arranged in various diameters wherein the sleeve retainers may be secured. Such a configuration may facilitate interchangability of numerous candle sleeves of varying dimensions with a single decorative candleholder and display.

The flame elevation maintenance device may maintain the flame at virtually any elevation. In one particular embodiment, the flame is maintained above the inner wall top edge for a desired lighting and display effect.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

Figure 1:
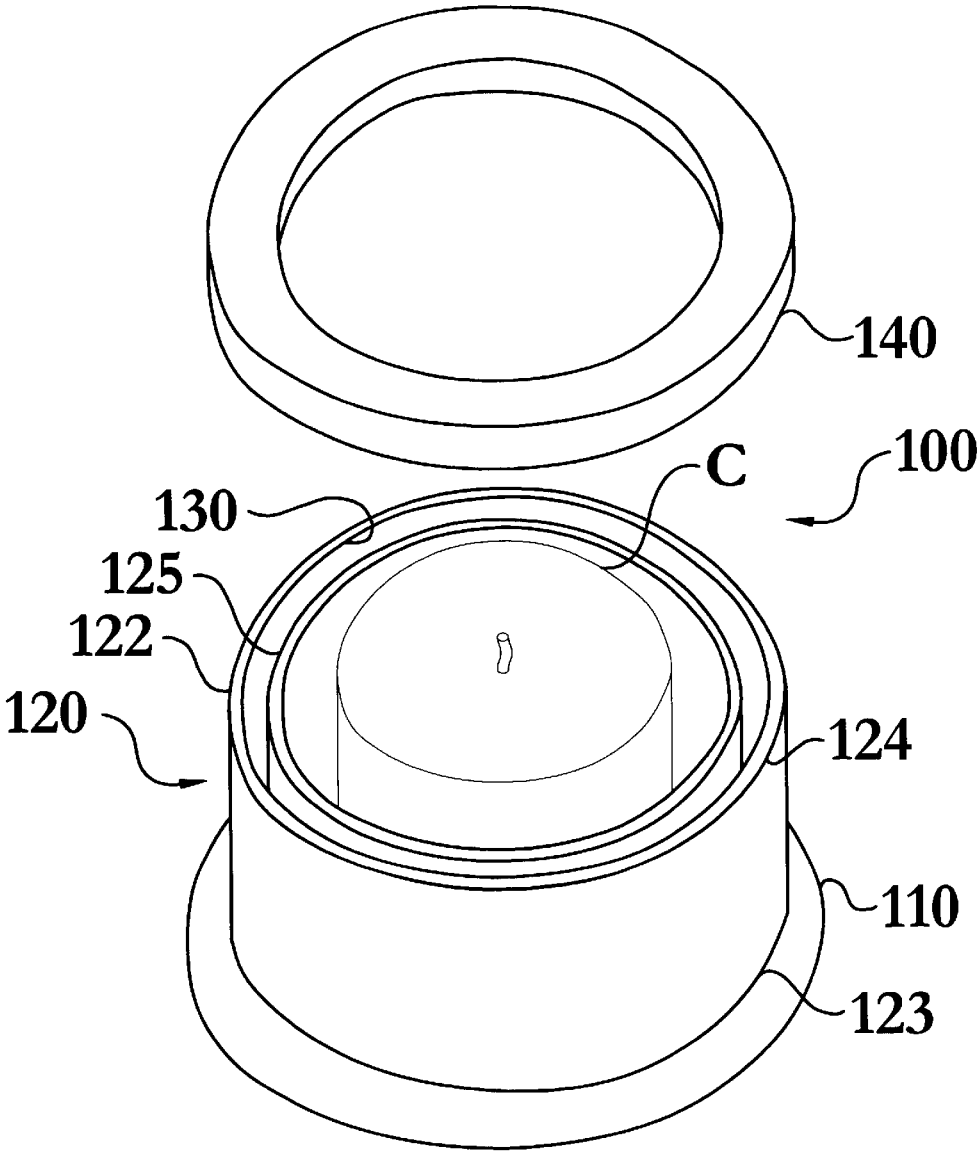
FIG. 1 shows a decorative candleholder and display apparatus wherein the components are shown in elevated perspective view, in reduced scale.

Also, in the various figures and drawings, the following reference symbols and letters are used to identify the various elements described herein below in connection with the several figures and illustrations: C, F, and M.

DESCRIPTION OF THE INVENTION

The decorative candleholder and display apparatus of the instant invention enables a significant advance in the state of the art. The preferred embodiments of the apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

With reference generally now to FIGS. 1 through 10, in one of the many preferable configurations, the decorative candleholder and display apparatus 100 incorporates, among other elements, a display 120, a display article 150, a cap 140, and a base 110. The decorative candleholder and display apparatus 100 is adapted to secure a candle C, having a flame F, and display a plurality of items in an internal cavity.

Figure 2:
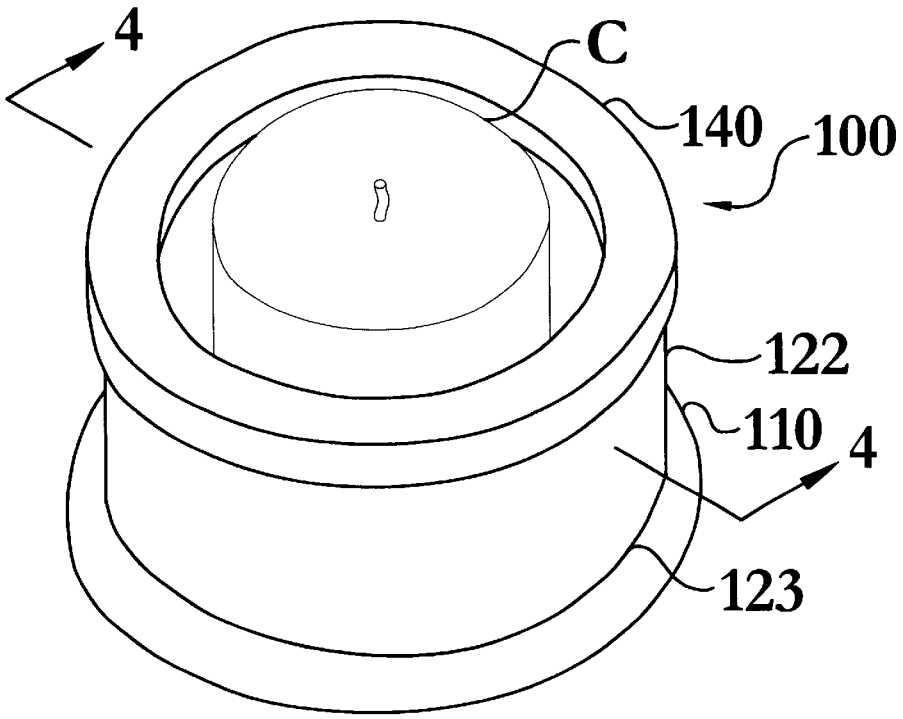
FIG. 2 shows a decorative candleholder and display apparatus wherein the components are shown in elevated perspective view, in reduced scale.
Figure 3:
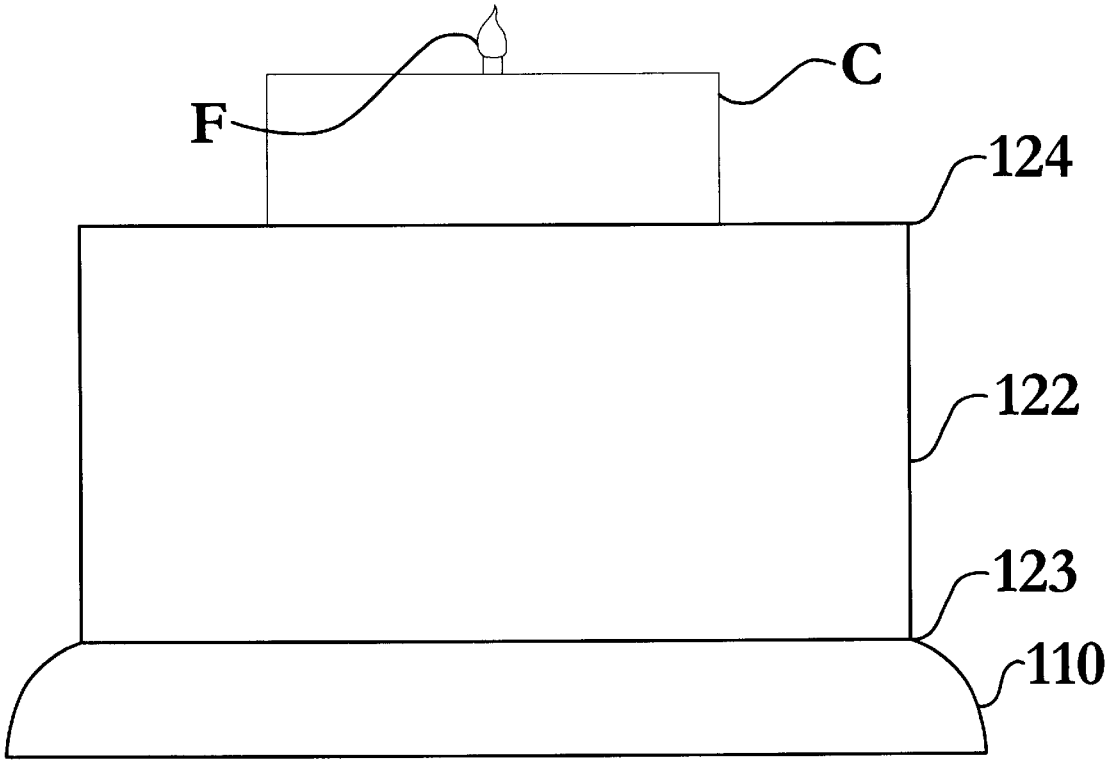
FIG. 3 shows a variation of the decorative candleholder and display apparatus of FIG. 1 in front elevation view, in reduced scale.
Figure 4:
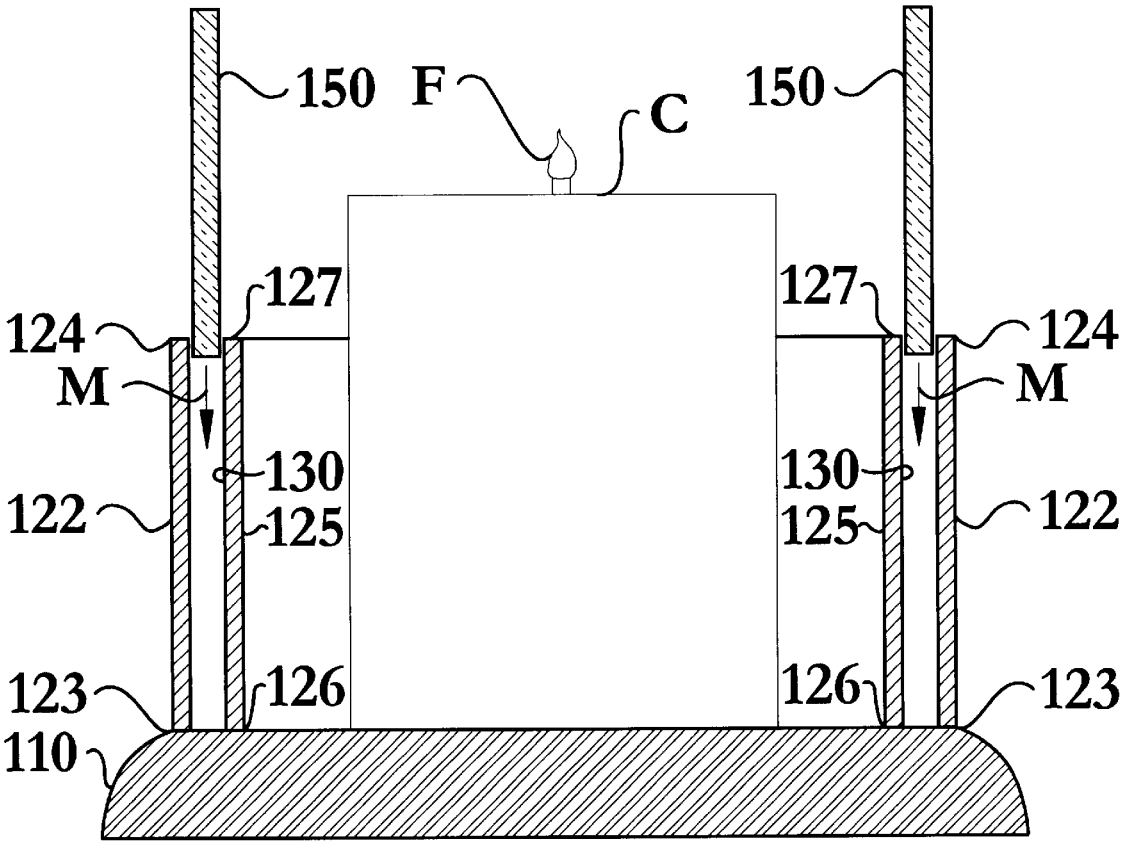
FIG. 4 shows a cross-sectional view of a variation of the decorative candle holder and display apparatus of FIG. 2 taken along line 4—4, in reduced scale.

Referring to FIG. 1, FIG. 2, and FIG. 3, the display 120 has an inner wall 125 and an outer wall 122. Referring now to FIG. 4, the inner wall 125 has an inner wall bottom edge 126, an inner wall top edge 127, and an inner wall periphery. Similarly, the outer wall 122 has an outer wall bottom edge 123 and an outer wall top edge 124. The inner wall 125 is located within the outer wall 122 thereby defining a display region 130 therebetween. A three-dimensional display article 150 may be inserted into the display region 130. Display regions 130 of varying sizes may be formed by varying the dimensions of the inner wall 125 and the outer wall 122. Various sizes of display regions 130 accommodate a wide range of display articles 150 including relatively thin articles such as photos, drawings, or needlework, or relatively thick articles such as dried flowers, seashells, quilting, and other three-dimensional articles.

The configuration of the inner wall 125 and the outer wall 122 may vary. For example, the walls 122, 125 may be circular, triangular, square, rectangular, or any polygon. Additionally, the inner wall 125 and outer wall 122 do not need to be the same shape.

Figure 5:
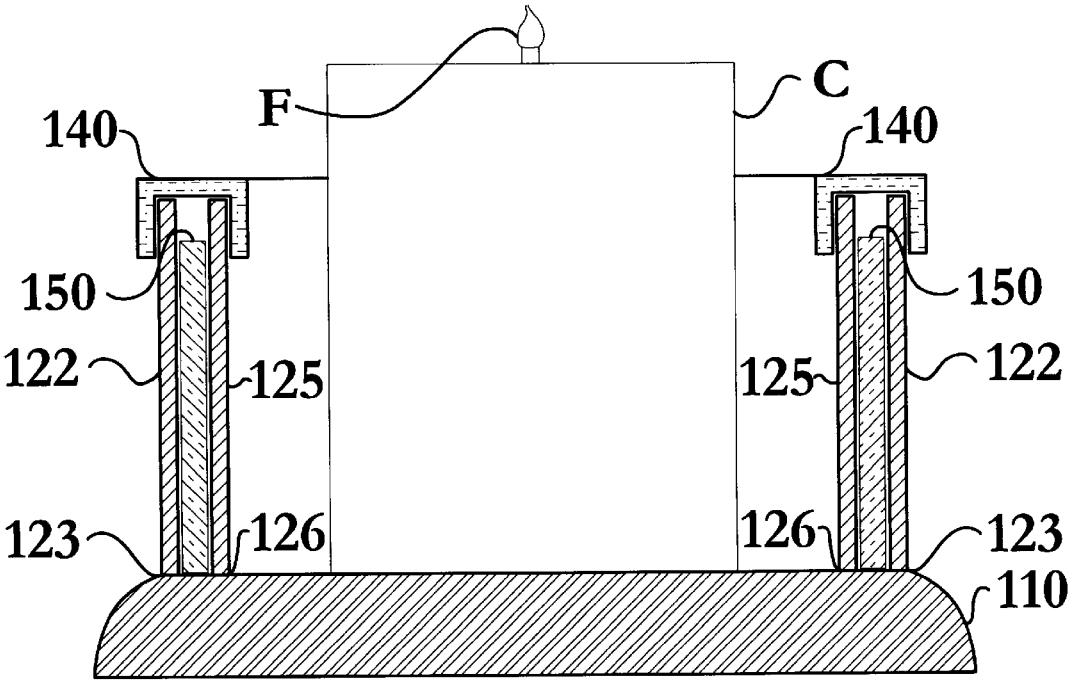
FIG. 5 shows a cross-sectional view of a variation of the decorative candle holder and display apparatus of FIG. 2 taken along line 4—4, in reduced scale.

A cap 140 releasably engages the outer wall top edge 124 and the inner wall top edge 127 thereby enclosing the display region 130 at the top edge of the walls 122, 125, and a base 110 that engages the outer wall bottom edge 123 and the inner wall bottom 126 edge thereby enclosing the display region 130 at the bottom of the walls 122, 125, as illustrated in FIG. 5. As shown in FIG. 4, when the cap 140 is removed the display article 150 may be placed into the display region 130, as shown by the direction of motion M. A further variation, not shown, includes the base 110 having a rotational mount allowing the decorative candleholder and display 100 to rotate 360 degrees facilitating viewing of the entire display 120. Similarly, also not shown, the interface between the outer and inner wall bottom edges 123, 126 and the base 110 may incorporate rotational interface allowing the display 120 to rotate 360 degrees while the base 110, and therefore the candle C, remains stationary.

Figure 6:
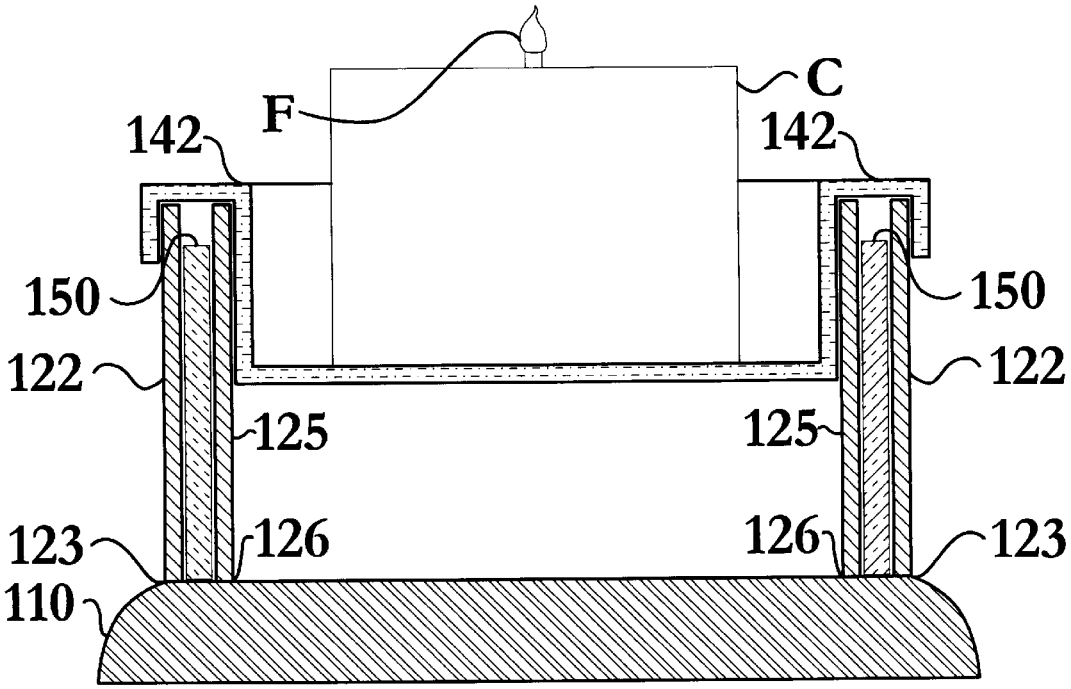
FIG. 6 shows a cross-sectional view of a variation of the decorative candle holder and display apparatus of FIG. 2 taken along line 4—4, in reduced scale.

Referring now to FIG. 6, in one of many variations of the present invention, the cap 140 further extends across the periphery of the inner wall 125 thereby forming an integral cap and candleholder 142. The integral cap and candleholder 142 may extend across the periphery of the inner wall 125 at any point between the inner wall top edge 127 and the inner wall bottom edge 126 accommodating candles of varying heights.

Figure 7:
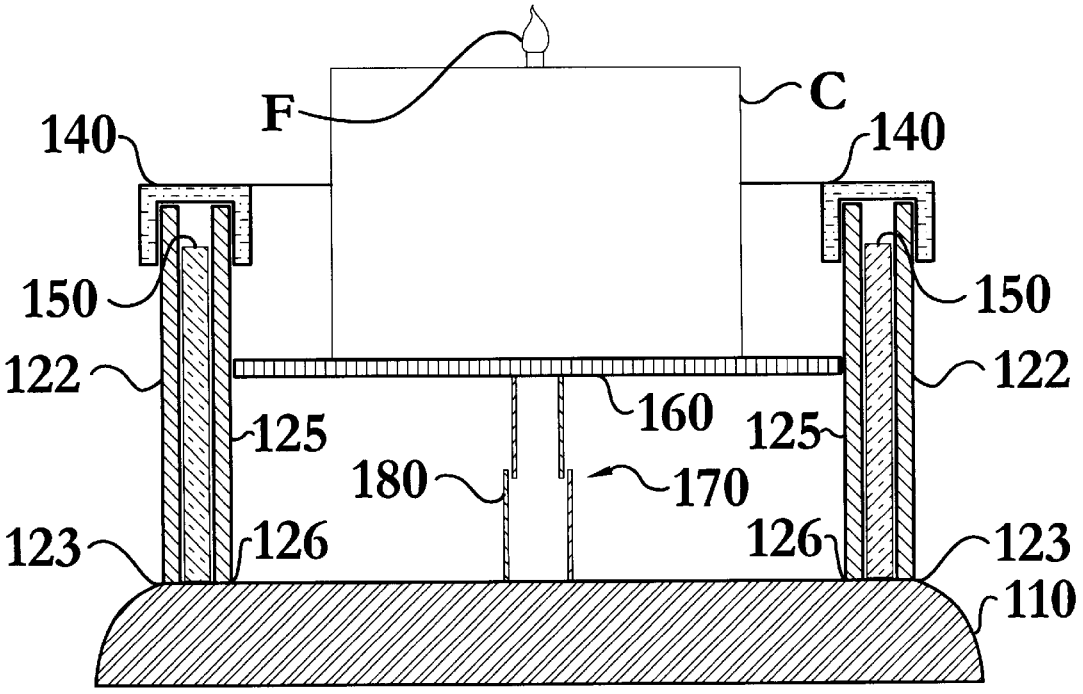
FIG. 7 shows a cross-sectional view of a variation of the decorative candle holder and display apparatus of FIG. 2 taken along line 4—4, in reduced scale.
Figure 8:
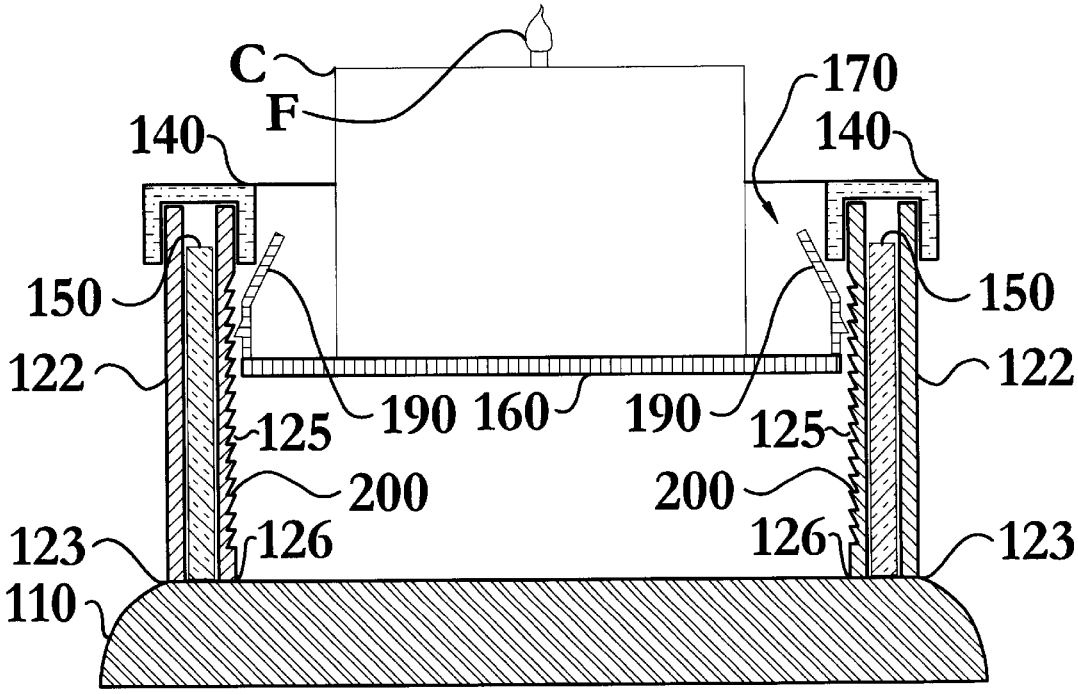
FIG. 8 shows a cross-sectional view of a variation of the decorative candle holder and display apparatus of FIG. 2 taken along line 4—4, in reduced scale.

Alternatively, the decorative candleholder and display 100 may include a height adjustment system 170 to raise and lower a candle support 160, as illustrated in FIG. 7 and FIG. 8. Raising and lowering the candle support 160 allows the elevation of the candle C and the flame F to be adjusted. The candle support 160 has a support periphery that lies within the inner wall periphery.

In one variation, shown in FIG. 7, the height adjustment system 170 may include a telescoping post 180 attached to the candle support 160 at a distal end and attached to the base 110 at a proximal end. The telescoping post 180 may include any number of variations. In one such variation the telescoping post 180 includes two threadedly engagable sections wherein the height of the candle support 160 is adjusted by threading a male threaded section into a female threaded section. In this case, either section may be secured to the candle support 160 so that the support elevation may be adjusted simply by rotating the candle support 160. Alternative variations of the telescoping post 180 include mechanical, electrical, pneumatic, and hydraulic variations including those whereby the height of the candle support 160 may be adjusted via an activation source in the base 110.

Referring now to FIG. 8, in a further variation of the height adjustment system 170, the inner wall 125 is formed with a plurality of inner wall engagement shelves 200. Further, a plurality of adjustable engagement devices 190 are attached to the support periphery and are received by the inner wall engagement shelves 200. Each of the adjustable engagement devices may include a bendable thumb-grip member which, when bent from an engagement position to a movement position, allows height adjustment of the candle support 160.

Figure 9:
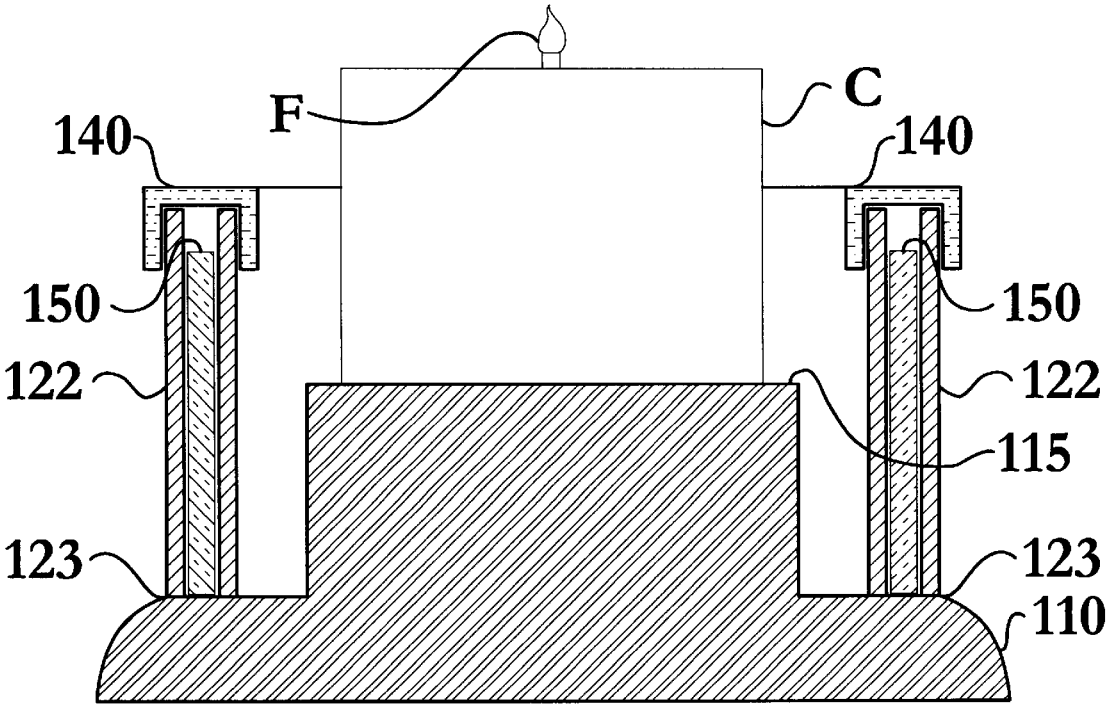
FIG. 9 shows a cross-sectional view of a variation of the decorative candle holder and display apparatus of FIG. 2 taken along line 4—4, in reduced scale.

In yet another variation illustrated in FIG. 9, the base 110 may be formed to extend upward, toward the inner wall top edge 127, to a predetermined elevation within the inner wall periphery to form an elevated base candle support 115. The predetermined elevation may be designed to complement standard candle sizes such that a preferred flame elevation is maintained when the candle C is at a predetermined state of consumption.

Figure 10:
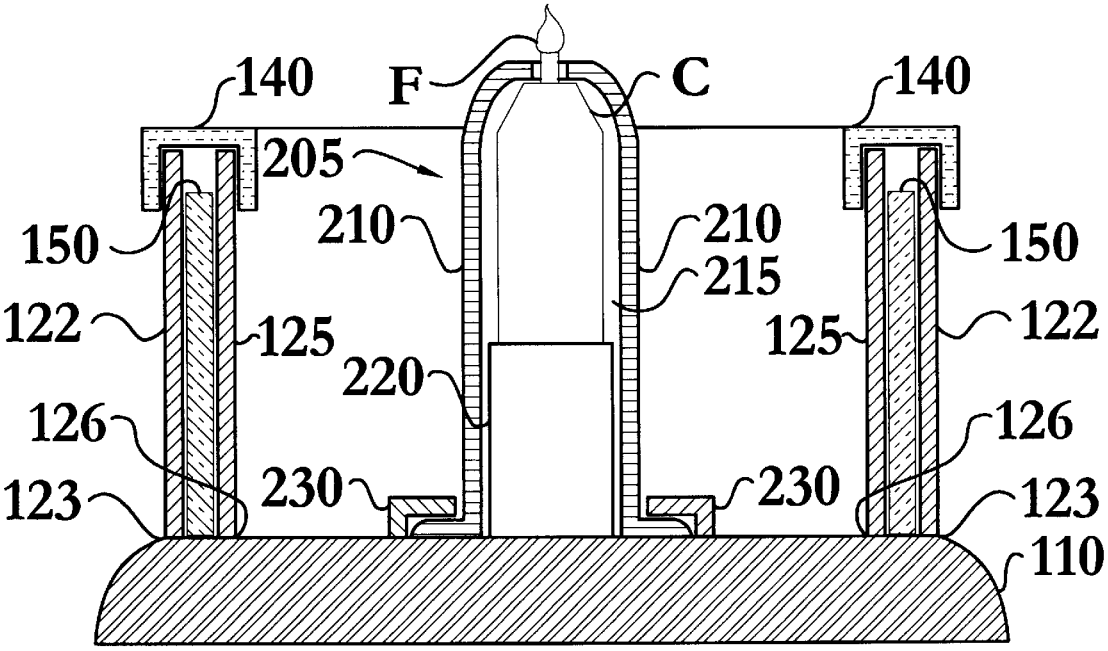
FIG. 10 shows a cross-sectional view of a variation of the decorative candle holder and display apparatus of FIG. 2 taken along line 4—4, in reduced scale.

Alternatively, a preferred flame elevation may be maintained using a flame elevation maintenance device 205. Referring now to FIG. 10, in one such variation, the flame elevation maintenance device 205 may include a candle sleeve 210 releasably mounted to the base 110 and formed to define a hollow region 215 for housing the candle C and a candle compression device 220. The candle compression device 220 acts to force the candle C against the candle sleeve 210 such that as the candle C melts, the compression device 220 expands thereby forcing the candle C against the sleeve 210 and maintaining the flame F at a preferred flame elevation. The candle compression device 220 may be as simple as a spring, or may include various mechanical, electrical, pneumatic, and hydraulic variations.

The size of candle sleeve 210 and compression device 220 may vary to accommodate the dimensions of any number of candles. An additional benefit of this variation of the flame elevation maintenance device 205 is that the candle C is confined within the candle sleeve 210 and is less likely to tip over and ignite the display 120 than a freestanding candle. The candle sleeve 210 may be secured to the base 110 in any number of ways. One example includes a plurality of sleeve retainers 230 releasably mounted to the base 110 that releasably secure the candle sleeve 210. As such, the sleeve retainers 230 may secure the candle sleeve 210 in a quick-connect quarter turn type fashion. Additionally, the sleeve retainers 230 may secure to the base 110 in a plurality of locations. For example, the base 110 may include a number of engagement positions arranged in various diameters wherein the sleeve retainers 230 may be secured. Such a configuration may facilitate interchangability of numerous candle sleeves 210 of varying dimensions with a single decorative candleholder and display 100.

The flame elevation maintenance device 205 may maintain the flame F at virtually any elevation. In one particular embodiment, the flame F is maintained above the inner wall top edge 127 for a desired lighting and display effect.

The elements of the apparatus 100 may be constructed of virtually any fire resistant materials. Generally, the outer wall 122 is constructed of transparent material to facilitate viewing of the display article 150. However, the outer wall 122 may be opaque to obtain a specific artistic effect. Further, the inner wall 125 may include a plurality of textured surface variations to aid in gripping the display article, adhesives, or design elements. Additionally, the base 110 and cap 140 may include any number of ornamental effects including surface ornamentation.

Further, any number of display frames may be inserted into the display region 130. The display frames may include variations for housing and displaying articles of varying sizes. For instance, display frames may allow the display of numerous photos of differing sizes along with other display element such as flowers and poems in a single display region 150.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

I claim:

1. A decorative candle holder and display apparatus adapted to secure a candle, having a flame, and a plurality of display items in an internal air-filled cavity, comprising:

a display having a substantially opaque inner wall, including an inner wall bottom edge and an inner wall top edge and an inner wall periphery, within a transparent outer wall, including an outer wall bottom edge and an outer wall top edge, thereby defining an air-filled display region therebetween;

a display article housed in the air-filled display region;

an interchangeable cap that releasably mechanically engages the outer wall top edge and the inner wall top edge and substantially seals the air-filled display region from the ambient atmosphere;

a central candle chamber sized such that a candle retained therein maintains an air gap between the candle and the inner wall of the display region; and a solid base that engages the outer wall bottom edge and the inner wall bottom edge.

2. The apparatus according to claim 1, wherein the cap further extends across the periphery of the inner wall thereby forming an integral cap and candleholder.

3. The apparatus according to claim 1, further comprising a height adjustment system to raise and lower a candle support, the candle support having a support periphery.

4. The apparatus according to claim 3, wherein the height adjustment system further comprises a telescoping post attached to the candle support at a distal end and attached to the base at a proximal end.

5. The apparatus according to claim 3, wherein the inner wall is formed with a plurality of inner wall engagement shelves that receive a plurality of adjustable engagement devices, included in the height adjustment system, attached to the support periphery.

6. The apparatus according to claim 1, wherein the base is formed to extend upward, toward the inner wall top edge, to a predetermined elevation within the inner wall periphery to form an elevated base candle support.

7. The apparatus according to claim 1, further including a flame elevation maintenance device.

8. The apparatus according to claim 7, wherein the flame elevation maintenance device further comprises a candle sleeve releasably mounted to the base and formed to define a hollow region for housing the candle and a candle compression device.

9. The apparatus according to claim 8, further including a plurality of sleeve retainers releasably mounted to the base, to releasably secure the candle sleeve.

10. The apparatus according to claim 7, wherein the flame elevation maintenance device maintains the flame above the inner wall top edge.

11. A decorative candle holder and display apparatus adapted to secure a candle, having a flame, and a plurality of display items in an internal air-filled cavity, comprising:

a display having a substantially opaque inner wall, including an inner wall bottom edge and an inner wall top edge and an inner wall periphery, within a transparent outer wall, including an outer wall bottom edge and an outer wall top edge, thereby defining an air-filled display region therebetween;

a display article housed in the air-filled display region;

an interchangeable cap that releasably mechanically engages the outer wall top edge and the inner wall top edge and substantially seals the air-filled display region from the ambient atmosphere;

a central candle chamber sized such that a candle retained therein maintains an air gap between the candle and the inner wall of the display region;

a solid base that engages the outer wall bottom edge and the inner wall bottom edge; and a height adjustment system to raise and lower a candle support, the candle support having a support periphery.

12. The apparatus according to claim 11, wherein the height adjustment system further comprises a telescoping post attached to the candle support at a distal end and attached to the base at a proximal end.

13. The apparatus according to claim 11, wherein the inner wall is formed with a plurality of inner wall engagement shelves that receive a plurality of adjustable engagement devices, included in the height adjustment system, attached to the support periphery.

14. The apparatus according to claim 11, further including a flame elevation maintenance device.

15. The apparatus according to claim 14, wherein the flame elevation maintenance device maintains the flame above the inner wall top edge.

16. A decorative candle holder and display apparatus adapted to secure a candle, having a flame, and a plurality of display items in an internal air-filled cavity, comprising:

a display having a substantially opaque inner wall, including an inner wall bottom edge and an inner wall top edge and an inner wall periphery, within a transparent outer wall, including an outer wall bottom edge and an outer wall top edge, thereby defining an air-filled display region therebetween;

a display article housed in the air-filled display region;

an interchangeable cap that releasably mechanically engages the outer wall top edge and the inner wall top edge and substantially seals the air-filled display region from the ambient atmosphere;

a central candle chamber sized such that a candle retained therein maintains an air gap between the candle and the inner wall of the display region;

a solid base that engages the outer wall bottom edge and the inner wall bottom edge; and a flame elevation maintenance device.

17. The apparatus according to claim 16, wherein the flame elevation maintenance device maintains the flame above the inner wall top edge.

18. The apparatus according to claim 16, wherein the base is formed to extend upward, toward the inner wall top edge, to a predetermined elevation within the inner wall periphery to form an elevated base candle support.

19. The apparatus according to claim 16, wherein the flame elevation maintenance device further comprises a candle sleeve releasably mounted to the base and formed to define a hollow region for housing the candle and a candle compression device.

20. The apparatus according to claim 19, further including a plurality of sleeve retainers releasably mounted to the base, to releasably secure the candle sleeve.

* * * * *